United States Patent [19]

Robertson et al.

[11] Patent Number: 4,759,669

[45] Date of Patent: Jul. 26, 1988

[54] VEHICLE TRANSPORTING RAILROAD CAR WITH HINGED DECK SECTION LOCK

[75] Inventors: James C. Robertson, Lawrenceville; Walter J. Marulic, Cumming, both of Ga.

[73] Assignee: Thrall Car Manufacturing Company, Chicago Heights, Ill.

[21] Appl. No.: 922,849

[22] Filed: Oct. 24, 1986

[51] Int. Cl.[4] ..... B61D 3/18

[52] U.S. Cl. ..... 410/29; 410/27

[58] Field of Search ..... 410/4, 26, 27, 29.1, 410/29, 81, 91, 132, 142; 105/370; 292/DIG. 20, 150, 163, 175, 302; 70/129

[56] References Cited

U.S. PATENT DOCUMENTS

| | | | |
|---|---|---|---|
| 472,088 | 4/1892 | Walker | 292/DIG. 20 X |
| 686,673 | 11/1901 | James | 292/175 |
| 1,023,014 | 4/1912 | Hanson | 292/175 |
| 3,426,704 | 2/1969 | Blunden | 410/27 |
| 4,059,055 | 11/1977 | Ravani et al. | 105/370 X |
| 4,119,042 | 10/1978 | Naves et al. | 410/27 |
| 4,238,168 | 12/1980 | Naves | 410/27 |
| 4,318,649 | 3/1982 | Roloness et al. | 410/27 |

FOREIGN PATENT DOCUMENTS

| | | | |
|---|---|---|---|
| 2170461 | 8/1986 | United Kingdom | 105/370 |

*Primary Examiner*—Robert B. Reeves
*Assistant Examiner*—Scott H. Werny
*Attorney, Agent, or Firm*—Marshall, O'Toole, Gerstein, Murray & Bicknell

[57] ABSTRACT

A railroad car for transporting vehicles comprising a first deck having side sills and being supported near each end by a railroad truck; a vertical side wall along each side of the car; each side wall including a plurality of spaced apart vertical columns having lower ends rigidly connected to each of the side sills; a second deck horizontally located above the first deck and rigidly connected to the columns; the second deck having a hinged section joined to each opposing end of a central portion, rigidly connected to the columns, to pivot about a horizontal axis; each hinged section being vertically pivotal and having an outer end with a lock attached to it to movably secure the outer end in upward and downward positions; each hinged section having side edges; a laterally movable, spring-biased rod along each hinged section side edge; the rod having a forward end extendable beyond the hinged section side edge into locking engagement with a retainer on the adjoining car wall; the rod forward end having outwardly sloping top and bottom flat surfaces; and the retainer having a sloped surface engageable with the rod top sloped surface, and the retainer having an upper sloped surface engageable with the rod bottom sloped surface. The spring progressively and continuously forces the rod farther and farther outwards when wear occurs between the retainer and rod surfaces, maintaining contact therebetween.

8 Claims, 6 Drawing Sheets

FIG.5
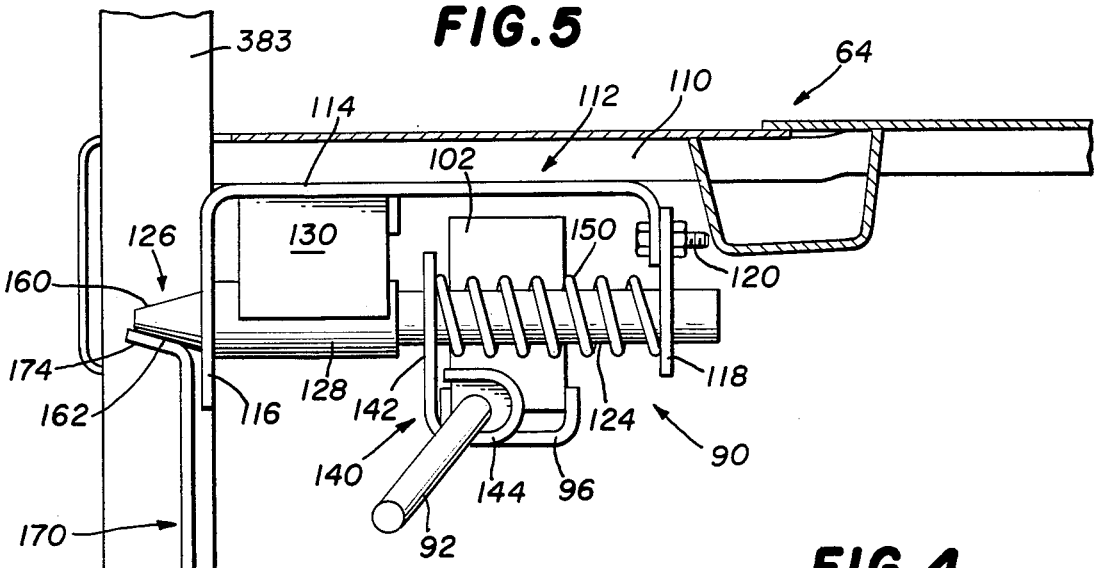
FIG.4
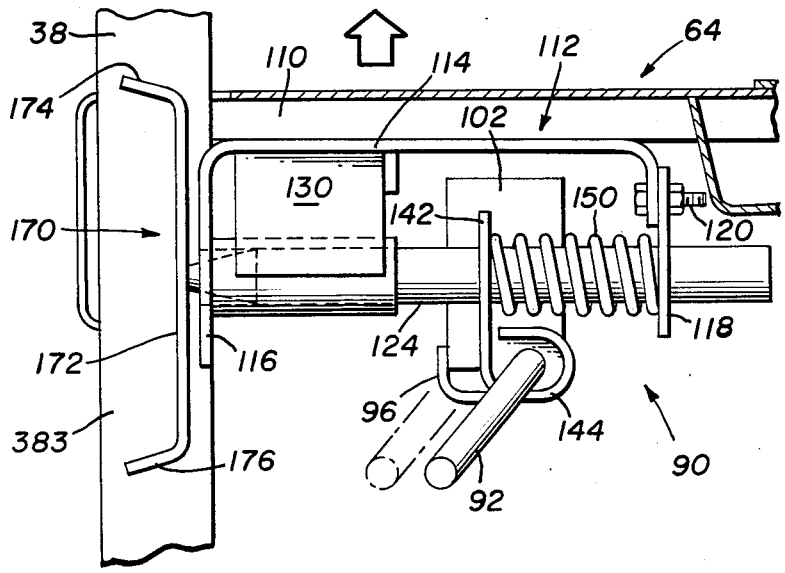
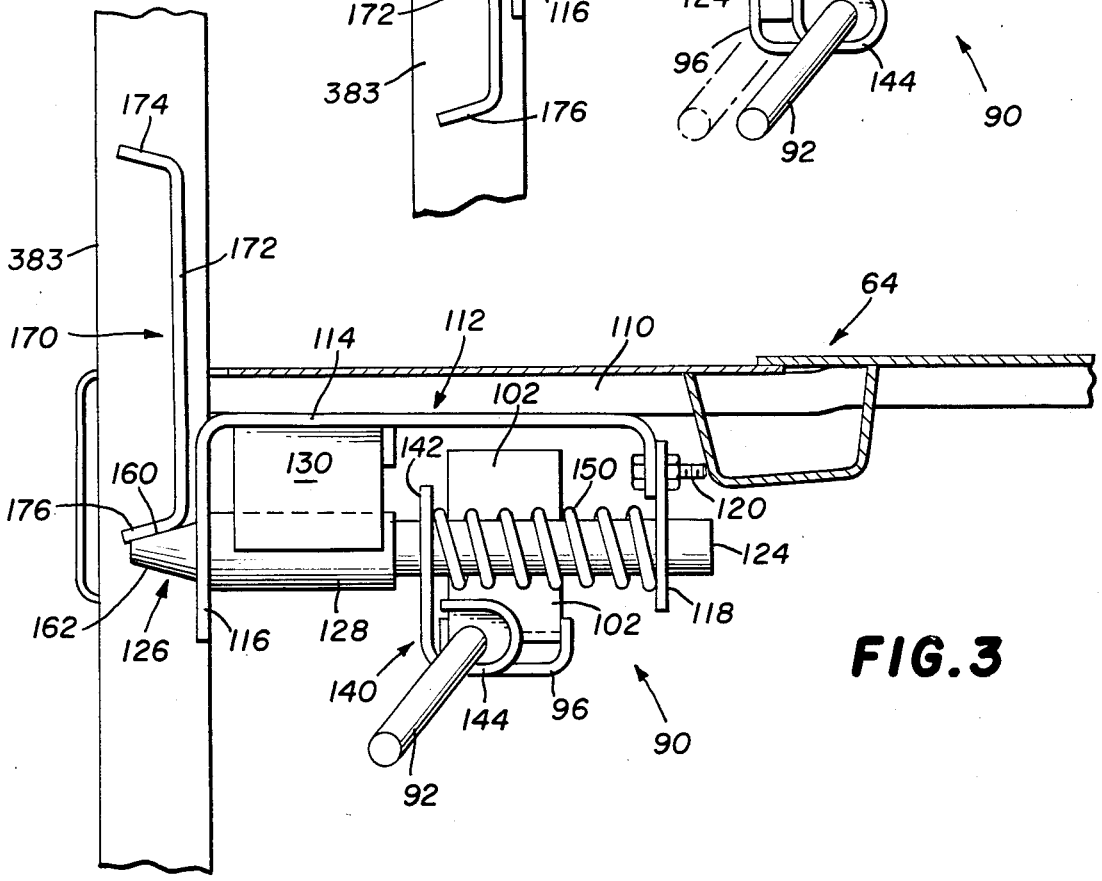
FIG.3

VEHICLE TRANSPORTING RAILROAD CAR WITH HINGED DECK SECTION LOCK

This invention relates to railroad cars used to transport vehicles such as automobiles and trucks, and which are generally referred to as auto rack cars. More particularly, this invention is concerned with a railroad car for transporting vehicles which has an improved locking device for maintaining one or more hinged upper deck sections in upward or downward position so as to provide temporary clearance for vehicles to pass between deck ends.

BACKGROUND OF THE INVENTION

Railroad cars are widely used in the United States and other countries to transport vehicles such as automobiles and trucks from manufacturing plants to distribution centers. Such railroad cars are referred to in the trade as auto rack cars.

The railroad cars include a first deck or floor and a pair of side walls which, if desired, support at least one, and often two, elevated decks. Additionally, a roof is generally included to protect the vehicles against damage. The decks carry lined-up, tied down vehicles.

Blunden U.S. Pat. No. 3,426,704 discloses a triple deck open topped railroad car for carrying vehicles. Each side of the car has a plurality of vertically positioned horizontally spaced apart columns or uprights which are joined to the lower deck side sills. These columns support the elevated second and third decks. The columns can also support wall panels to protect the vehicles against vandalism.

In many vehicle-carrying railroad cars, including the car disclosed in Blunden U.S. Pat. No. 3,426,704, the ends of the first deck are higher because the draft sill of the underframe is raised to meet the common coupling requirements with adjacent rail cars in a train. This reduces the vertical clearance between the ends of the first and second decks to an extent which prevents many vehicles from passing through. To provide the required clearance it has been found necessary to hingedly mount the end sections of the second deck so that they can be rotated upwardly a short distance to thereby obtain the necessary vertical clearance between the ends of the first and second decks. Blunden U.S. Pat. No. 3,426,704 discloses a car with such hinged deck sections.

The hinged deck sections are generally counterbalanced so as to be held in raised position. They are pulled down manually to abut a horizontal position when the second deck is to be loaded with vehicles. Stop means limits vertical upward and downward displacement of the hinged deck sections. However, for safety reasons and efficient loading of the second deck, it is conventional to lock the deck sections in place when in either of the stated positions. A locking device in use for this purpose comprises a rod or pin which is removably inserted in a hole in a locking plate on the car wall. Because of wear on the pin and the hole wall during car use excessive clearance develops which permits the deck sections to vibrate and shake, thereby inducing further rapid wear of the locking device. Because of this, a need exists for an improved locking device which will secure the hinged deck sections in place, minimize wear and adjust to wear which occurs so as to maintain a tight locking condition.

SUMMARY OF THE INVENTION

According to the invention a railroad car for transporting vehicles is provided comprising a first deck having side sills and supported near each end by a railroad truck; a vertical side wall along each side of the car; each side wall including a plurality of spaced apart vertical columns having lower ends rigidly connected to each of the side sills; a second deck horizontally located above the first deck and rigidly connected to the columns; the second deck having a hinged section joined to each opposing end of a central portion, rigidly connected to the columns, to pivot about a horizontal axis; each hinged section being vertically pivotal and having an outer end with lock means attached to it to movably secure the outer end in upward and downward positions; each hinged section having side edges; a laterally movable rod along each hinged section side edge; the rod having a forward end extendable beyond the hinged section side edge into locking engagement with a retainer on the adjoining car wall; the rod forward end having outwardly sloping top and bottom flat surfaces; and the retainer having a lower sloped surface engageable with the rod top sloped surface, and the retainer having an upper sloped surface engageable with the rod bottom sloped surface.

The car desirably has first stop means which limits maximum upward movement of the hinged section and second stop means which limits maximum downward movement of the hinged section when it is empty or it is supporting one or more vehicles loaded on the hinged section.

Spring means is desirably included to continuously force the rod into tight locking position with a rod sloped surface in forced mating contact with a retainer or locking plate sloped surface when the rod is less than fully outwardly extended by the spring means.

A counterbalance can be included so as to move the hinged section into maximum upward position when the hinged section is empty of vehicles.

BRIEF DESCRIPTION OF THE DRAWINGS

FIG. 3 is a front elevational view of a locking device with the outer end of a hinged deck section locked in down position by the locking device;

FIG. 4 is similar to FIG. 3 but with the locking device unlocked and the hinged deck section midway between down and up positions;

FIG. 5 is similar to FIG. 3 but with the hinged deck section locked in up position by the locking device;

FIG. 13 is a sectional view taken along the line 13—13 of FIG. 12.

DETAILED DESCRIPTION OF THE DRAWINGS

To the extent it is reasonable and practical the same or similar elements or parts which appear in the various views of the drawings will be identified by the same numbers.

Figure 1:
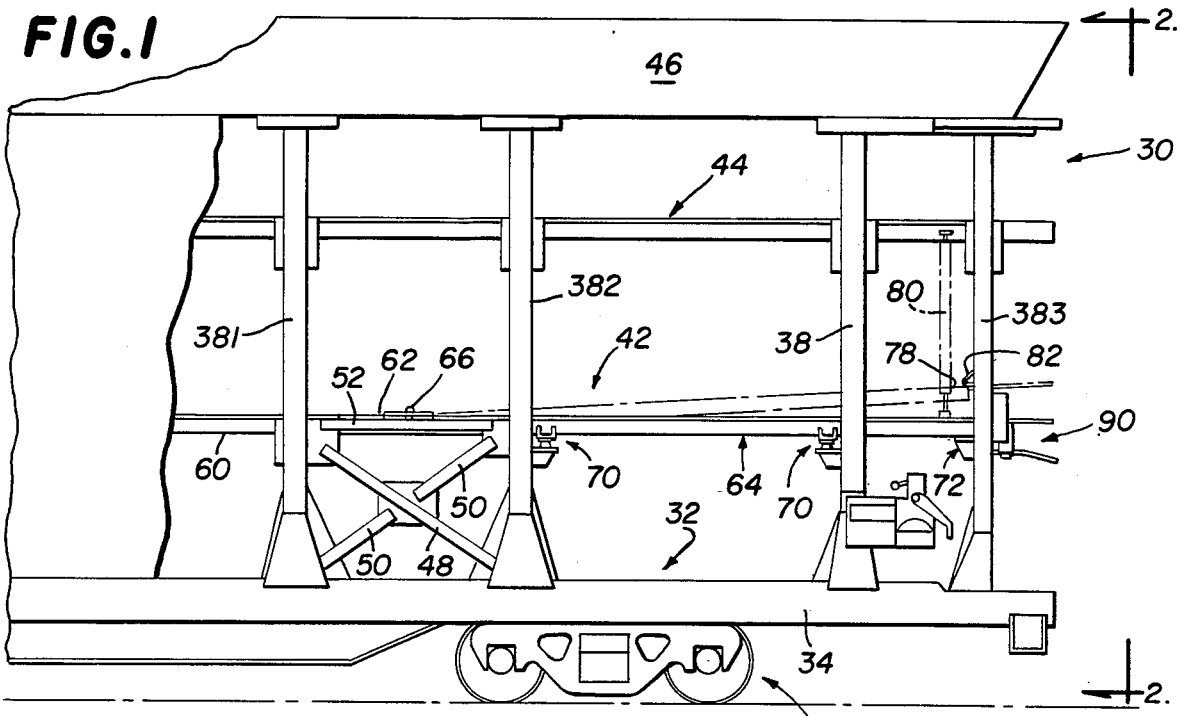
FIG. 1 is a side elevational view of one end of a railroad car for carrying vehicles.
Figure 2:
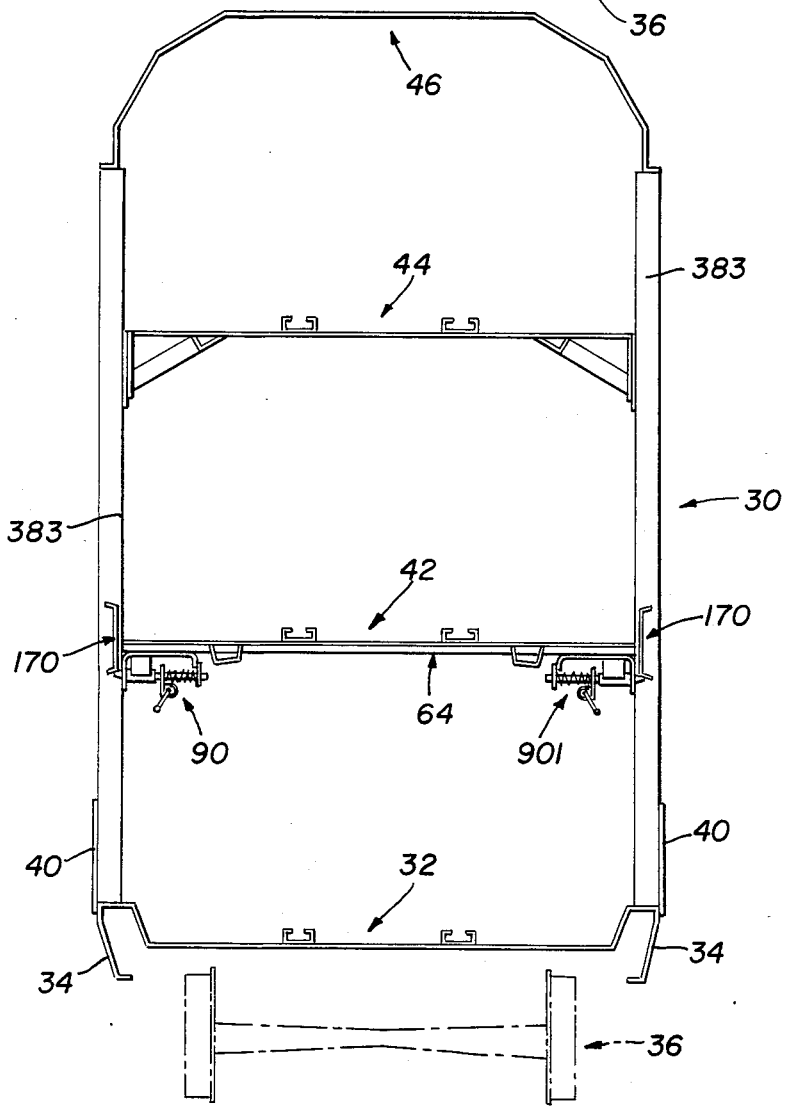
FIG. 2 is an end elevational view taken along the line 2—2 of FIG. 1.

The car 30 shown in FIGS. 1 and 2 has a first deck or floor 32 with longitudinal side sills 34 extending for essentially the length of the car. The deck 32 is supported by conventional railroad trucks 36 at each end. A plurality of vertical spaced apart columns 38 are located along each car side with a column 383 at each end. The lower ends of the columns 38,383 are rigidly connected to the side sills 34. A trapezoid-shaped plate 40 is joined to the lower end of each column 38 and the side sill 34 for reinforcement.

The columns 38,383 support an elevated second deck 42 above the first deck 32, an elevated third deck 44 above the second deck 42, and a roof 46 at the top of the columns. Each end of the car is provided with a door (not shown) which can be opened to permit loading and unloading of vehicles and then closed for transport purposes.

The car 30 shown in FIGS. 1 and 2 has a pair of columns 381,382 like columns 38, positioned near each end of each side of the car. The columns 381,382 are more closely spaced adjacent each other than are the columns 38. The car 30 has a brace bay area between each pair of the adjacent columns 381,382. An X-brace made of members 48,50 extends between the two adjacent columns 381,382 and the first and second decks 32,42. Horizontal brace 52 extends between the two columns 381,382 along the side edge of second deck 42.

The second deck 42 has a central or middle portion 60 which is rigidly connected to the columns 381. Each end 62 of the central portion 60 terminates between the pairs of columns 381,382. Extending outwardly from each of the ends 62 is a hinged section 64 which is pivotly joined thereto by hinge means 66 so that rotation about a horizontal axis can be readily effected.

Each hinged section 64 rests on two load bearing stops or supports 70, attached to the adjacent columns 38,382, and on stops 72 on end column 383, so as to maintain the hinged deck section in approximately horizontal position when the second deck is loaded or partially loaded with vehicles.

Each support 70 includes a male conical vertical element 71 joined to bracket 73 on a respective column 38,382 and a female hollow conical vertical element 74 joined to bracket 75 on the edge of hinged deck section 64 (FIGS. 1 and 9 to 11). When the hinged deck section 64 is down each support 70 has its pair of conical elements 71,74 in nesting arrangement with each other, thereby restricting horizontal movement of the hinged deck section.

The forward end of hinged deck section 64 is also supported when in down position by a stop 72 (FIGS. 1 and 12) which is joined to end column 383. Stop 72 includes a horizontal plate 76 and a vertical brace 79.

The free end 78 of each hinged deck section 64 is vertically displaceable upwardly about ten to twelve inches from horizontal position. A spring 80 is attached to each side of hinged deck section 64 and third deck 44. The springs 80 continuously urge the hinged section 64 upwardly but maximum upward movement is limited by one or more stops 82 (FIGS. 6 and 12) on end columns 383 at the end of the car.

It usually is necessary to have the hinged sections 64 in upward position when vehicles are loaded onto, or unloaded from, the first deck 32 because the ends of first deck 32 are usually higher than the remaining portion of the deck. This reduces the vertical clearance between the ends of the first and second decks. Unless the clearance is increased at least temporarily loading and unloading of vehicles on the first deck can not be done safely or at all because the vehicle roofs will hit the upper deck. Hinging of the deck end sections provides the required temporary clearance and it also permits the second deck to be horizontally positioned when loaded with vehicles.

For safety reasons and operating efficiency a pair of locking devices 90,901 is provided which are capable of locking the hinged section 64 in maximum upward and downward positions. The locking devices 90,901 are mounted on the forward bottom side edges of hinged section 64. The locking devices 90,901 are mirror images of each other but are otherwise identical. Accordingly, only the elements of locking device 90 will be identified, it being understood that locking device 901 has identical but mirror image elements.

The locking device 90 has a handle 92 with one end 94 loosely secured to channel member 96 by vertical bolt 98. Bolt 98 also extends through flange 100 at the lower end of bracket 102 which is connected to vertical support plate 104. The plate 104 is connected to deck reinforcing channel member 106.

Connected to the bottom of laterally positioned deck reinforcing channel member 110 is a bracket 112 having a horizontal web 114 and spaced apart downwardly depending vertical flanges 116,118. The flange is removably connected to web 114 by two bolts 120.

A hole is provided in flange 116 to receive the forward end 126 of rod 124. A stub tube 128 is mounted to flange 116. The stub tube 128 has an axial hole which is axially positioned with respect to the hole in flange 116. The rod 124 is sized to fit loosely in the hole in stub tube 128 so that it can slide freely therein. Tab strips 130 extend from web 114 to stub tube 128 and serve to stiffen the structure.

A handle support 140 is connected to rod 124. The handle support 140 has a vertical plate 142 which ends in a hook 144 at its lower end. Plate 142 is fixedly connected to rod 124 so that they move as a unit. The handle 92 extends through the hook 144 and is supported by it. Coil spring 150 is mounted in compression on rod 124 between plate 142 and flange 118 which is removable to permit installation of the spring and the rod. Clearance is provided between the end of stub tube 128 and plate 142 so that the rod 124 is continuously urged into locking position by spring 150, even after locking has been accomplished. The forward or locking end 126 of rod 124 has a flat sloped top surface 160 and a flat sloped bottom surface 162.

Mounted on the side of column 383 is a retainer or locking plate 170 having a vertical web 172 and top and bottom sloping flanges 174,176. The top sloped surface 160 on the end of rod 124 mates in face-to-face contact with the surface of flange 176 in locking position when the hinged deck section 64 is in down position (FIG. 3). The end 126 of rod 124 is not fully forwardly extended in such locked position so that such face-to-face contact can be maintained even after substantial wear of the mating surfaces has occurred. The action of spring 150 continually forces the end 126 of the rod 124 outwardly, thereby maintaining such contact even after wearing has taken place. It is to be understood that the described locking arrangement requires that the hinged deck section 64 be in downward position resting on supports 70,72 which bar any further lower displacement.

Figure 6:
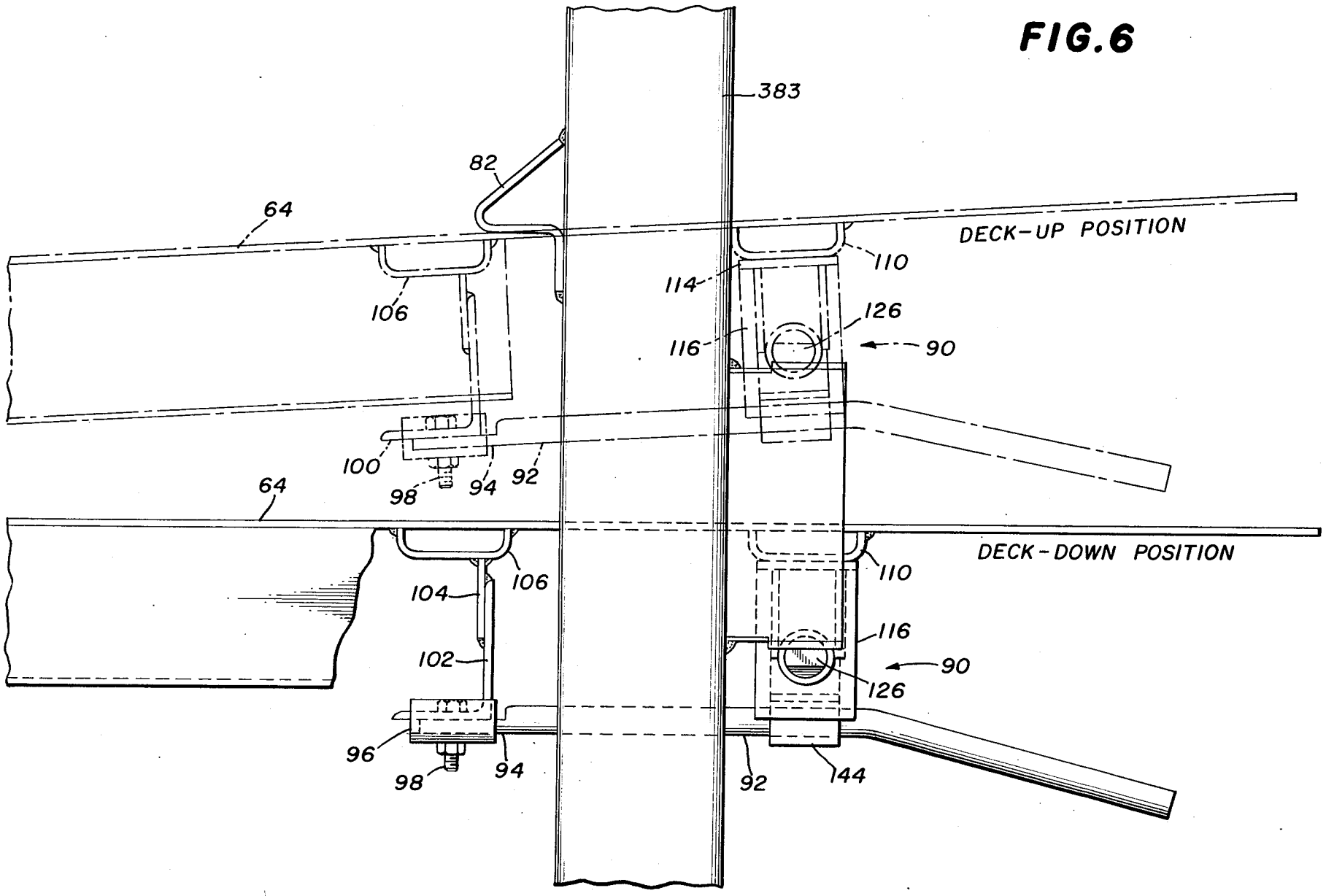
FIG. 6 is a side elevational view, partially cut away and in phantom, of the locking device locking the hinged deck section in down and up positions.
Figure 7:
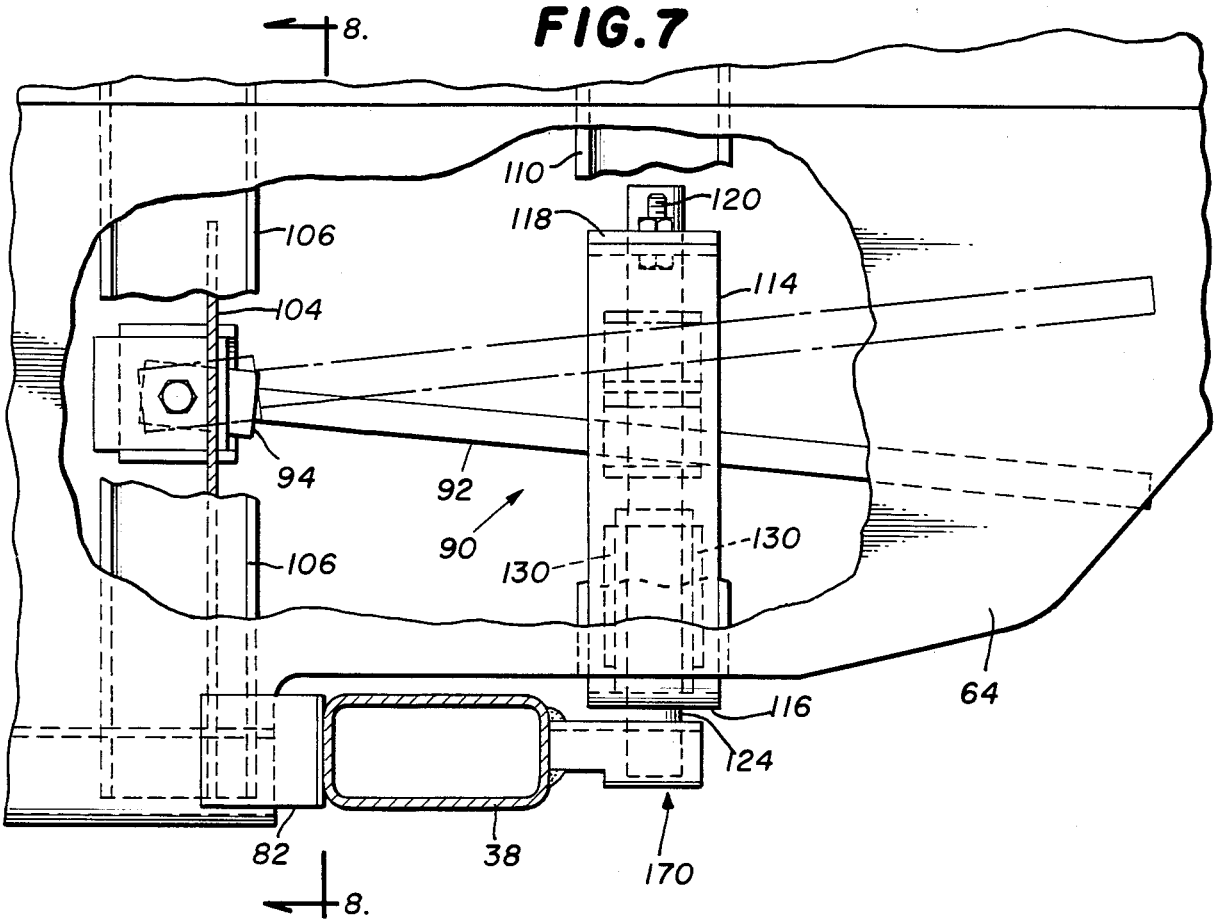
FIG. 7 is a plan view, partially broken away and in phantom, of the locking device shown in FIGS. 3 to 6.
Figure 8:
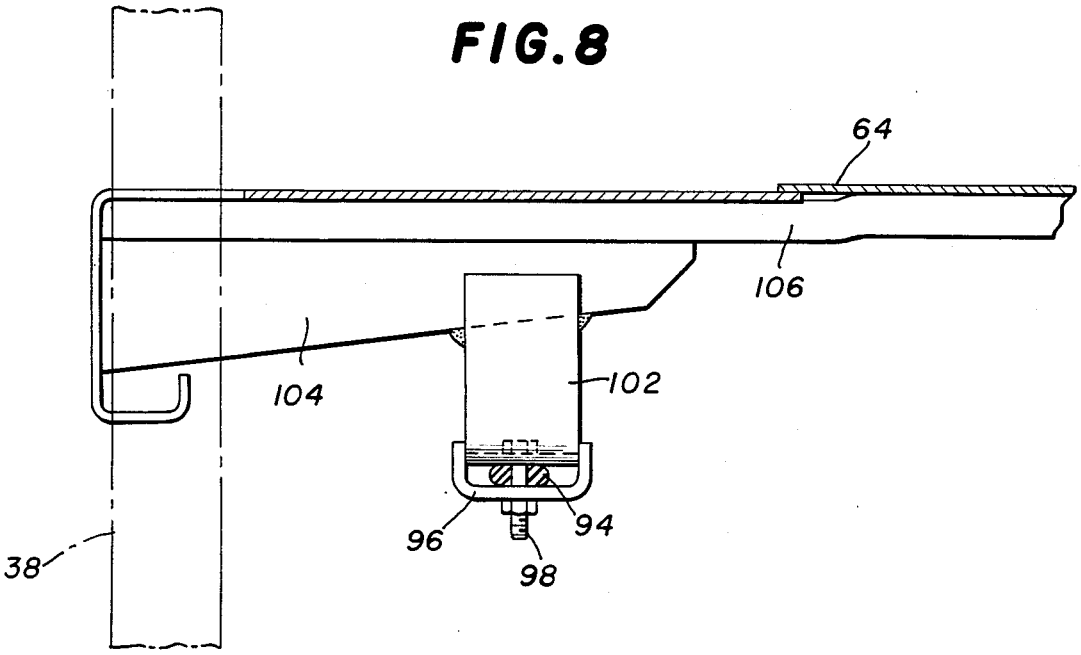
FIG. 8 is a sectional view taken along the line 8—8 of FIG. 7.
Figure 9:
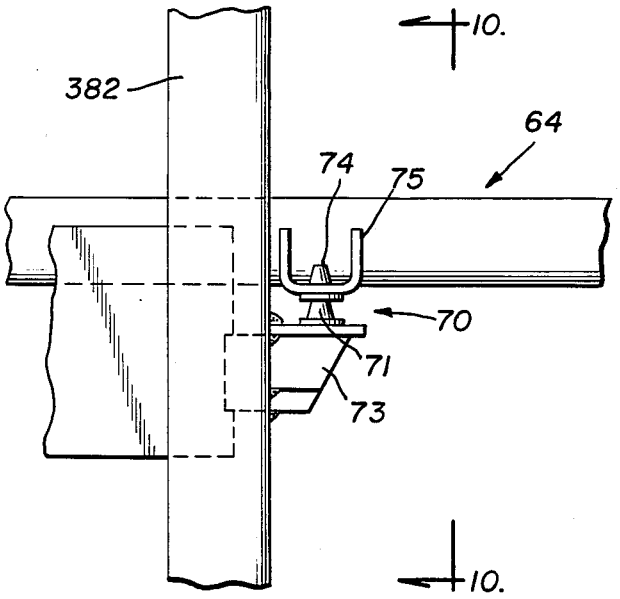
FIG. 9 is a side elevational view of a support for the hinged deck section.
Figure 10:
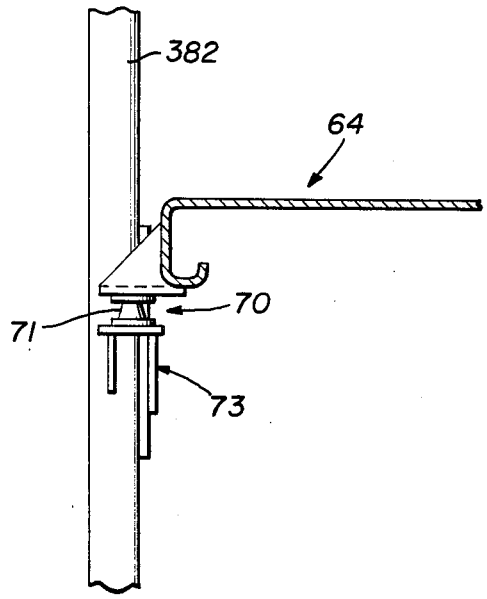
FIG. 10 is a sectional view taken along the line 10—10 of FIG. 9.
Figure 11:
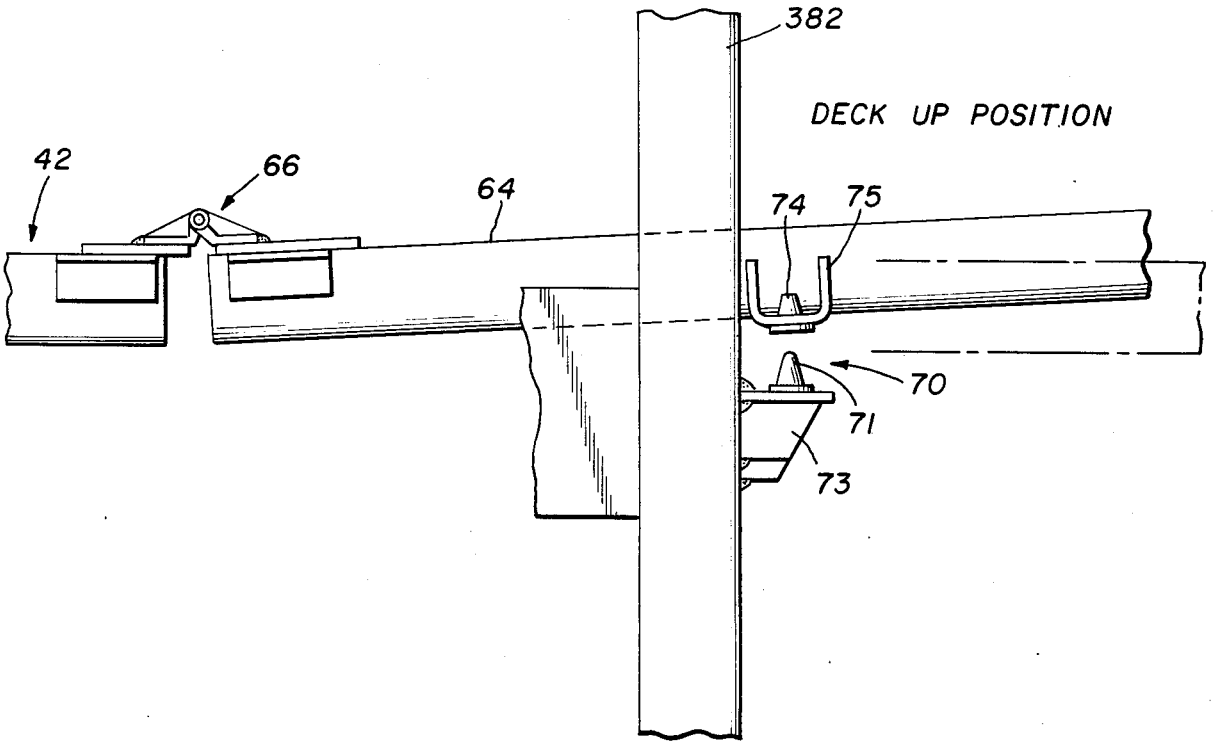
FIG. 11 is a side elevational view similar to FIG. 9 but with the hinged deck section in up position.
Figure 12:
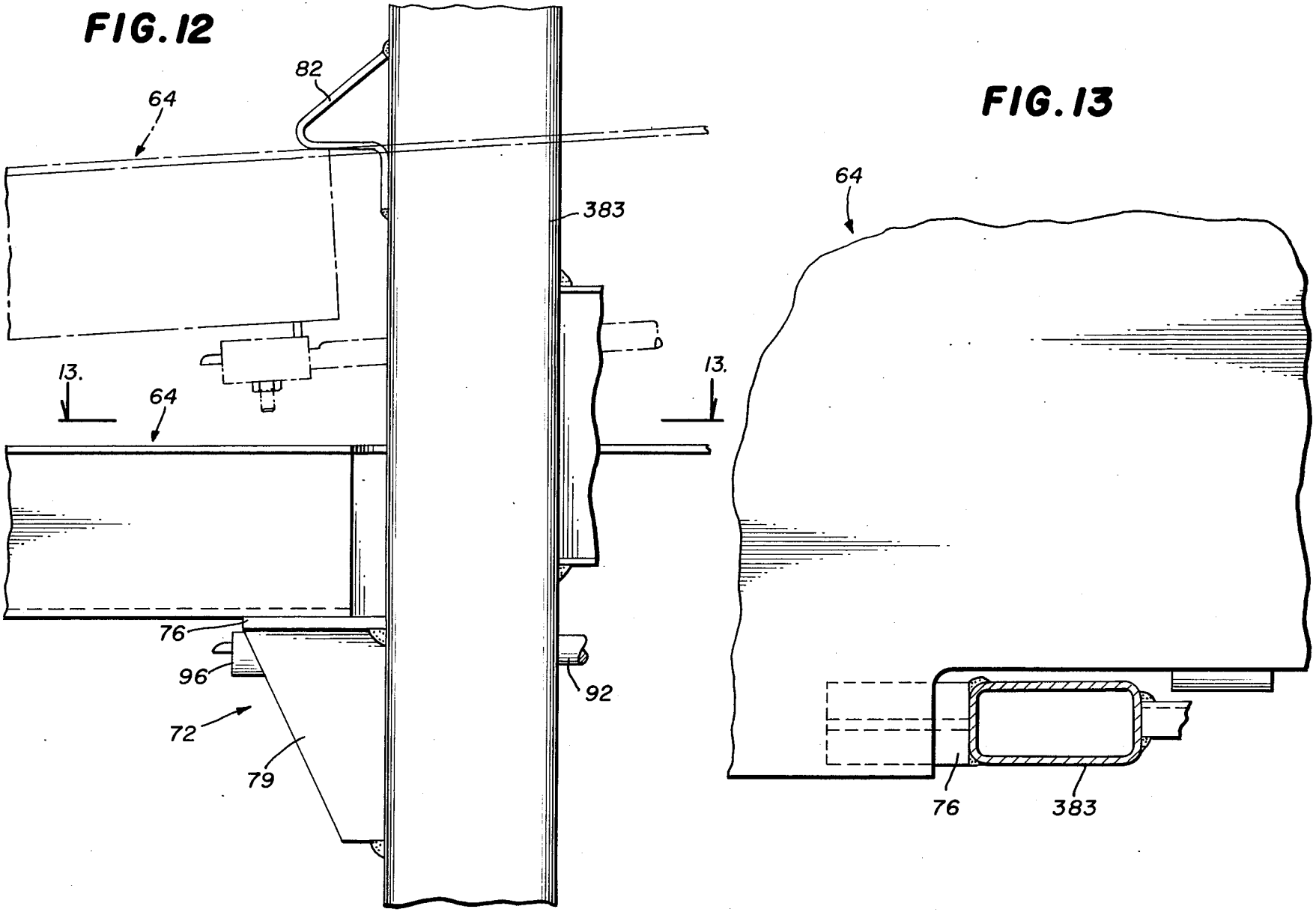
FIG. 12 is a side elevational view similar to FIG. 6 but showing a support on a corner column for the hinged deck section.

When it becomes necessary to move hinged deck section 64 upwardly, the handle 92 is moved manually horizontally to axially displace rod 124 and withdraw it from locking position with flange 176. The tip of rod end 126 then slides against the surface of vertical web 172 (FIG. 4) as lifting springs 80 raise the deck section 64 until it hits stop 82 (FIGS. 6 and 12). By the time deck station 64 reaches the lifted or upward position the rod 124 will have been forced forward by spring 150 so that rod sloped end surface 162 is in position to contact the surface of flange 174 in face-to-face mating contact (FIG. 5). Such contact is maintained even after the mating surfaces wear because spring 150 continually urges the rod outwardly thereby compensating for and overcoming the loss of material caused by wear. To lower the hinged deck section 64 from raised or upward position the handle 92 is moved to slide the rod 124 to the right and then the deck section is pulled down until horizontal and locked into position (FIG. 3).

The foregoing detailed description has been given for clearness of understanding only, and no unnecessary limitations should be understood therefrom, as modifications will be obvious to those skilled in the art.

What is claimed is:

1. A railroad car for transporting vehicles comprising:

a first deck having side sills and being supported near each end by a railroad truck;

a vertical side wall along each side of the car;

each side wall including a plurality of spaced apart vertical columns having lower ends rigidly connected to each of the side sills;

a second deck horizontally located above the first deck and rigidly connected to the columns;

the second deck having a hinged section joined to each opposing end of a central portion, rigidly connected to the columns, to pivot about a horizontal axis;

each hinged section being vertically pivotal and having an outer end with lock means attached to it to movably secure the outer end in upward and downward positions;

each hinged section having side edges;

said lock means including a laterally movable rod along each hinged section side edge;

the rod having a forward end extendable beyond the hinged section side edge into locking engagement with a retainer on the adjoining car wall;

the rod forward end having outwardly sloping, top and bottom, flat surfaces;

the retainer having a lower, sloped flat surface engageable with the rod top, sloped flat surface, and the retainer having an upper, sloped, flat surface engageable with the rod bottom sloped flat surface; and spring means which forces the rod into tight locking position with a sloped, rod flat surface in forced mating contact with a sloped, retainer flat surface, said contact stopping the rod at a less than fully extended position, and allowing the rod to be progressively and continuously forced farther and farther outwards by said spring when wear occurs between said mating surfaces, to maintain contact therebetween.

2. A railroad car according to claim 1 in which first stop means limits maximum upward movement of the hinged section and second stop means limits maximum downward movement of the hinged section and supports vehicles when transported on the hinged section.

3. A railroad car according to claim 1 including means to counterbalance the hinged section to maintain it in maximum upward position when the hinged section is empty of vehicles.

4. A railroad car according to claim 2 in which:

when the lower, rod sloped flat surface engages the upper, retainer sloped flat surface, the hinged deck section is locked in maximum upward position against the first stop means; and when the upper, rod sloped flat surface engages the lower, retainer sloped flat surface the hinged deck section is locked in maximum downward position against the second stop means.

5. A railroad car according to claim 1 in which:

when the hinged deck section is locked in up position, only the lower rod sloped flat surface contacts the upper retainer sloped flat surface; and when the hinged deck section is locked in down position, only the upper rod sloped flat surface contacts the lower, retainer sloped flat surface.

6. A railroad car for transporting vehicles comprising:

a first deck having side sills and supported near each end by a railroad truck;

a vertical side wall along each side of the car;

each side wall including a plurality of spaced apart vertical columns having lower ends rigidly connected to each of the side sills;

a second deck horizontally located above the first deck and rigidly connected to the columns;

the second deck having a hinged section joined to each opposing end of a central portion, rigidly connected to the columns, to pivot about a horizontal axis;

each hinged section being vertically pivotal and having an outer end with lock means attached to it to movably secure the outer end in upward and downward positions;

each hinged section having side edges;

said lock means including a laterally movable rod along each hinged section side edge;

the rod having a forward end extendable beyond the hinged section side edge into locking engagement with a retainer on the adjoining car wall;

the rod forward end having outwardly sloping top and bottom flat surfaces;

the retainer having a lower, sloped flat surface engageable with the rod top, sloped flat surface, and the retainer having an upper, sloped flat surface engeable with the rod bottom, sloped flat surface;

first stop means limiting maximum upward movement of the hinged section and second stop means limiting maximum downward movement of the hinged section and supporting the hinged section when vehicles are on the hinged section; and means which forces the rod into tight locking position with a sloped, rod flat surface in forced mating contact with a sloped, retainer flat surface, said contact stopping the rod at a less than fully extended position, and allowing the rod to be progressively and continuously forced farther and farther outwards by said spring when wear occurs between said mating surfaces, to maintain contact therebetween.

7. A railroad car according to claim 6 in which:

when the lower, rod sloped flat surface engages the upper, retainer sloped flat surface the hinged deck section is locked in maximum upward position against the first stop means; and when the upper, rod sloped flat surface engages the lower, retainer sloped flat surface the hinged deck section is locked in maximum downward position against the second stop means.

8. A railroad car according to claim 6 in which:

when the hinged deck section is locked in up position only one of the rod, sloped flat surfaces contacts a retainer, sloped flat surface; and when the hinged deck section is locked in down position only one of the rod, sloped flat surfaces contacts a retainer, sloped flat surface.

* * * * *